US009235222B2

(12) United States Patent
Oh et al.

(10) Patent No.: US 9,235,222 B2
(45) Date of Patent: Jan. 12, 2016

(54) HYBRID REGULATOR WITH COMPOSITE FEEDBACK

(71) Applicant: RF Micro Devices, Inc., Greensboro, NC (US)

(72) Inventors: Wonseok Oh, Chandler, AZ (US); Hyuntae Kim, Tempe, AZ (US); Praveen Nadimpalli, Chandler, AZ (US)

(73) Assignee: RF Micro Devices, Inc., Greensboro, NC (US)

( * ) Notice: Subject to any disclaimer, the term of this patent is extended or adjusted under 35 U.S.C. 154(b) by 281 days.

(21) Appl. No.: 13/896,035

(22) Filed: May 16, 2013

(65) Prior Publication Data

US 2013/0307506 A1 Nov. 21, 2013

Related U.S. Application Data

(60) Provisional application No. 61/648,147, filed on May 17, 2012.

(51) Int. Cl.

| | |
|---|---|
| ***G05F 1/56*** | (2006.01) |
| ***G05F 1/10*** | (2006.01) |
| ***G05F 1/575*** | (2006.01) |

(52) U.S. Cl.
CPC *G05F 1/10* (2013.01); *G05F 1/575* (2013.01); *G05F 1/562* (2013.01)

(58) Field of Classification Search
CPC ..... G05F 1/445; G05F 1/562; G05F 1/563; G05F 1/575
USPC ..... 323/222, 225, 226, 268, 270, 271, 273, 323/275, 280, 282, 285
See application file for complete search history.

(56) References Cited

U.S. PATENT DOCUMENTS

| | | | | |
|---|---|---|---|---|
| 4,390,829 | A | 6/1983 | Jarrett | |
| 4,879,506 | A | 11/1989 | Braun | |
| 5,825,233 | A * | 10/1998 | Lamarche et al. | 327/365 |
| 6,281,667 | B1 * | 8/2001 | Matsumura | G05F 1/565 323/274 |
| 6,731,728 | B2 * | 5/2004 | Hollenbach et al. | 379/93.36 |
| 6,967,470 | B2 * | 11/2005 | Takabayashi | 323/224 |
| 7,402,985 | B2 * | 7/2008 | Zlatkovic | 323/275 |
| 2012/0105045 | A1 * | 5/2012 | Burns et al. | 323/311 |

* cited by examiner

*Primary Examiner* — Matthew Nguyen
(74) *Attorney, Agent, or Firm* — Withrow & Terranova, P.L.L.C.

(57) ABSTRACT

A hybrid voltage regulator includes a shunt circuit, a shunt feedback circuit, a pass circuit, and a bias controller. The bias controller is configured to control the pass circuit. The hybrid voltage regulator may also include a current source. This hybrid voltage regulator reduces current consumption at low load conditions (improving power efficiency and battery life, particularly for CMOS based regulators), and also provides wideband power supply rejection and fast transient response.

15 Claims, 10 Drawing Sheets

HYBRID REGULATOR

SERIES REGULATOR
(RELATED ART)

MODIFIED SERIES REGULATOR
(RELATED ART)

SHUNT REGULATOR
(RELATED ART)

SHUNT REGULATOR WITH CAPACITOR
(RELATED ART)

HYBRID REGULATOR

HYBRID REGULATOR WITH MIRROR

HYBRID REGULATOR
WITH CURRENT SOURCE

HYBRID REGULATOR WITH MIRROR AND CURRENT SOURCE

HYBRID REGULATOR WITH COMPOSITE FEEDBACK

RELATED APPLICATIONS

This application claims the benefit of provisional patent application Ser. No. 61/648,147, filed May 17, 2012, the disclosure of which is hereby incorporated herein by reference in its entirety.

FIELD OF THE DISCLOSURE

This application is directed to voltage regulators, and particularly to shunt voltage regulators used to supply conditioned voltage for electronic circuitry.

BACKGROUND

Regulated voltage (or regulated power) is essential for electronic circuitry. Related art provides two general approaches: a series voltage regulator, and a shunt voltage regulator. Each related art approach has advantages and disadvantages.

FIG. 1 illustrates a series voltage regulator 100 from related art. An unregulated voltage VDD is conditioned to a desired output voltage Vout by a series voltage regulator. The series voltage generator includes two major circuits: a pass circuit, and a pass feedback circuit. The pass feedback circuit attempts to maintain a constant desired output voltage Vout.

The pass circuit PC1 is configured to pass a pass current Ipass from VDD to output node Nout, wherein output node Nout has an output voltage of Vout. The pass feedback circuit PFC1 is configured to control the pass circuit as a function of Vout.

In one embodiment of a pass feedback circuit, Vout is reduced (or "voltage divided") by a series of resistors R1 and R2, and the resulting voltage Vdiv feeds into error amplifier AMP6. For example, if R1 and R2 are equal, then Vdiv is half of Vout. Error amplifier AMP6 compares Vdiv to a reference voltage Vref, and outputs a feedback voltage or error voltage V6.

Specifically, the error amplifier AMP6 outputs an error voltage V6 proportional to the "error" between Vdiv and the reference Vref. This error voltage V6 adjusts (if necessary) the output voltage Vout. In FIG. 1, an excessive Vout causes a positive error voltage V6 and decreases the pass current Ipass, in turn decreasing the output voltage.

Specifically, in FIG. 1 the error voltage V6 from the pass feedback circuit PFC1 is tied to the gate of a PMOS power transistor MP6 in the pass circuit. If Vdiv exceeds Vref, then the error is positive (Vout is too high), the error voltage V6 is positive, and the positive voltage Vamp linked to the gate of PMOS transistor MP6 tends to open the normally closed transistor, thus reducing the pass current flow Ipass and reducing Vout.

Power transistor MP6 is known as a "pass" transistor, because output voltage Vout is controlled (at least partially) by passing current through the pass transistor towards output node Nout. Current flow Ipass is known as a "pass" current.

If Vout is reduced substantially, either by feedback effects or by a large load current (not shown), then Vdiv is reduced, the difference between Vdiv and Vref is reduced, error voltage V6 is reduced, and the voltage at the gate of PMOS transistor MP6 is reduced, thus tending to close the normally closed transistor MP6, increasing the current flow Ipass through MP6, and increasing Vout.

In light load (or no load) conditions, Vout is relatively high, Vdiv is relatively high, V6 is relatively high, the voltage at the gate of PMOS transistor MP6 is increased, and the current Ipass through MP6 is relatively low. Thus, the related art series regulator is efficient under light load conditions.

Further, the series voltage regulator provides high PSR (Power Supply Rejection) and good load and line regulation. However, the series voltage regulator has some drawbacks: the PSR has a narrow band, and the transient response is slow in light load conditions.

Shunt voltage regulators are discussed below. Shunt voltage regulators avoid some of these drawbacks of series voltage regulators, but also have their own drawbacks.

FIG. 2 illustrates a modified series voltage regulator 200 from related art. FIG. 2 is similar to FIG. 1, with the addition of an output capacitor Co to help damp out output voltage Vout fluctuations, and with unregulated voltage VDD serving as a power supply to AMP6. Alternatively, Vout may serve as a power supply to AMP6 (not shown).

FIG. 3 illustrates a shunt voltage regulator 300 from related art, comprising three major parts: a shunt circuit SC3, a shunt feedback circuit SFC3, and a constant current source Isource.

The shunt feedback circuit SFC3 is very similar to the above pass feedback circuit PFC1. The difference is that the error voltage V8 of error amplifier AMP8 is connected to a shunt circuit SC3 in shunt voltage regulator 300 (instead of to a pass circuit PC1 in the series voltage regulator 100).

Further, the shunt circuit SC3 works somewhat "backwards" from the pass circuit described above. In the shunt circuit SC3, a high error voltage V8 to transistor MN8 increases shunt current Ishunt, thus decreasing Vout. Also, shunt voltage regulator 300 requires the constant current source Isource in order to drive the voltage Vout.

Specifically, transistor MN8 in FIG. 3 is an NMOS transistor that is normally open (in contrast to the PMOS transistor in FIG. 1). Thus, in low load conditions Vout is initially relatively high, Vdiv is relatively high (greater than Vref), and a large error voltage V8 tends to close NMOS transistor MN8, allowing a large current (a shunt current Ishunt) to shunt through the transistor and towards ground, thus decreasing Vout.

Transistor MN8 is known as a "shunt" transistor, because output voltage Vout is controlled by shunting current through the shunt transistor away from node Nout and towards a ground.

Under high load conditions, Vout is initially relatively low, Vdiv is relatively low, V8 is relatively low, shunt transistor MN8 is relatively open (small shunt current Ishunt), and thus the output voltage Vout is driven higher due to Isource.

The shunt voltage regulator 300 gives relatively wideband power supply rejection (PSR), and relatively fast transient response. However, the shunt voltage regulator has a large current consumption at low loads because the current source Isource remains on at all times. At low load conditions, almost all of Isource is shunted as Ishunt through shunt transistor MN8.

FIG. 4 illustrates a shunt voltage regulator 400 with a capacitor Co from related art. FIG. 4 is very similar to FIG. 3, with the addition of an output capacitor Co to dampen fluctuations in Vout, and with Vout serving as a power supply to error amplifier AMP8. VDD may alternatively serve as a power supply to error amplifier AMP8 (not shown).

In FIG. 4, a small current I1 provides current to power error amplifier AMP8. Another small current I2 provides current for the voltage divider resistors R1 and R2 to generate Vdiv.

Other performance measures such as size and efficiency are also important in voltage regulators. The current source Isource may be created using various technologies including: bipolar transistors; zener diodes; and CMOS diodes. Of these options, only the CMOS diodes may be created with standard CMOS processes. However, these CMOS diodes must be sized for the maximum load current condition and operate under the maximum current condition at all load conditions (because these diodes form a constant current source). Also, the efficiency of a CMOS diode based constant current source is low, due to the almost 0.7V voltage drop across CMOS diodes. Further, the shunt transistor MN8 must be a very large size to shunt off virtually all of the current from the constant current source at the no load condition, because currents I2 (to resistor R1) and I1 (to the power supply input of error amplifier AMP8) are very small.

Compared to the series voltage regulator 100, the shunt voltage regulator 300 gives wideband power supply rejection (PSR) and fast transient response. However, the shunt regulator has high power consumption because the current source Isource is always on, and is shunted away through the shunt current Ishunt during periods of low load. This results in high power consumption during periods of low load.

Thus, there is a need for a hybrid voltage regulator that has the good qualities of the series regulator and of the shunt regulator, while avoiding the bad qualities of the series regulator and of the shunt regulator.

SUMMARY

The present disclosure relates to a hybrid voltage regulator including: a shunt circuit, a shunt feedback circuit, a pass circuit, and a bias controller configured to control the pass circuit. The hybrid voltage regulator may also include a current source.

This hybrid voltage regulator reduces current consumption at low load conditions (improving power efficiency and battery life, particularly for CMOS based regulators), and also provides wideband power supply rejection and fast transient response.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

Figure 5:
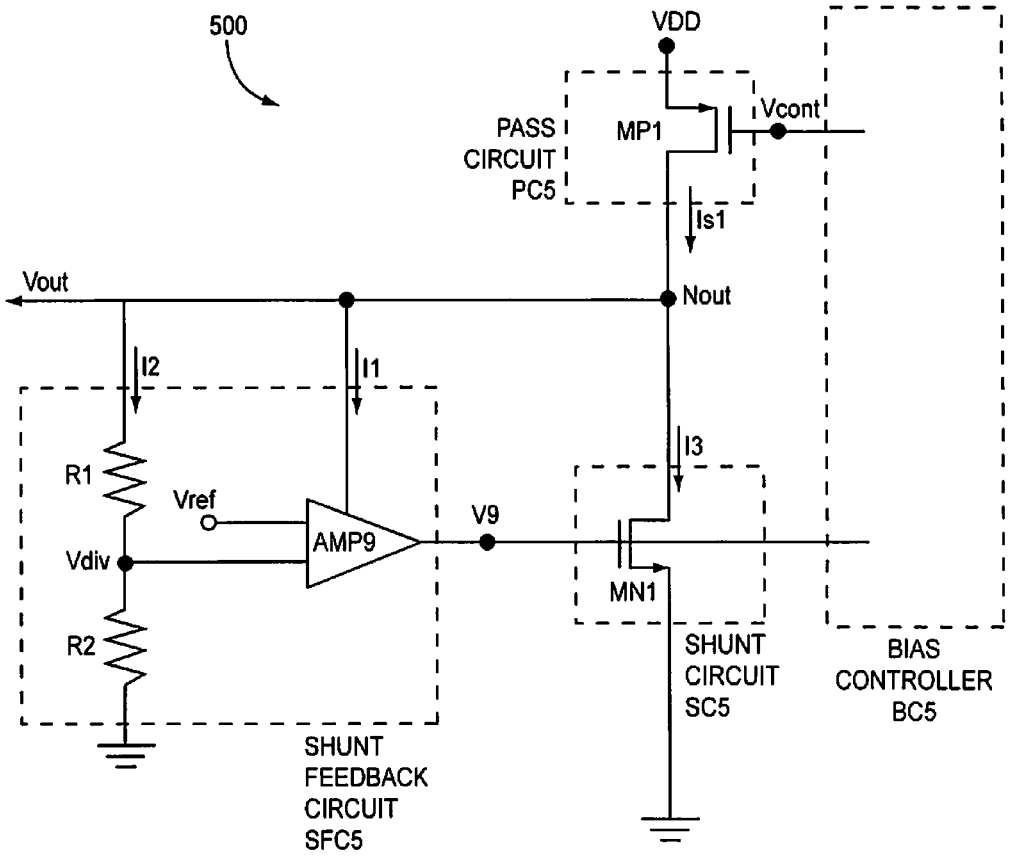
FIG. 5 illustrates a hybrid voltage regulator.

FIG. 5 illustrates a hybrid voltage regulator 500 that includes aspects of a series voltage regulator 100 and aspects of a shunt voltage regulator 300. Specifically, the hybrid voltage regulator 500 includes the following major portions: a shunt circuit SC5, a shunt feedback circuit SFC5, a pass circuit PC5, and a bias controller BC5 configured to control the pass circuit PC5. The hybrid voltage regulator 500 may also include a constant current source (not shown).

The shunt feedback circuit SFC5 is similar to those discussed above, and error amplifier AMP9 outputs an error voltage V9 to the shunt circuit. The shunt circuit SC5 is similar to those discussed above, and shunts a shunt current I3.

Figure 1:
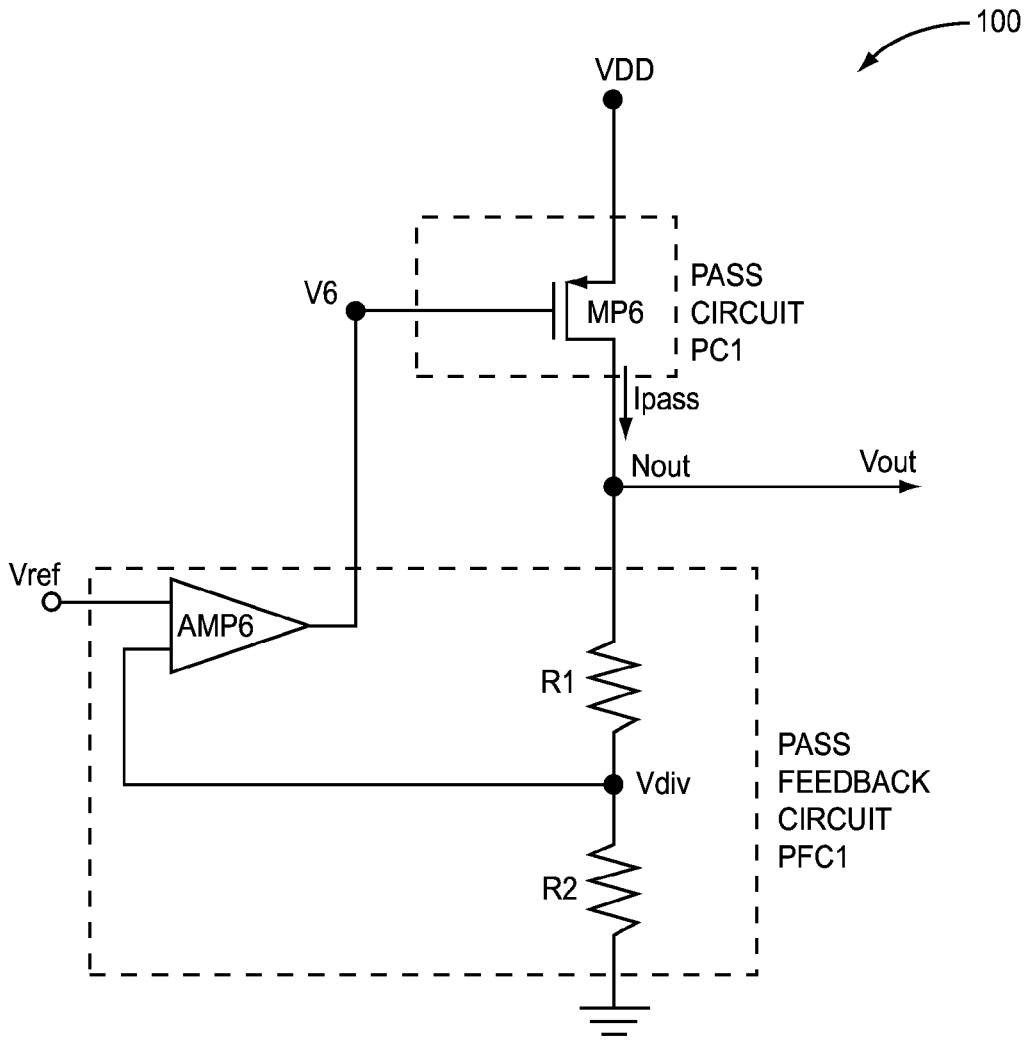
FIG. 1 illustrates a series voltage regulator from related art.
Figure 2:
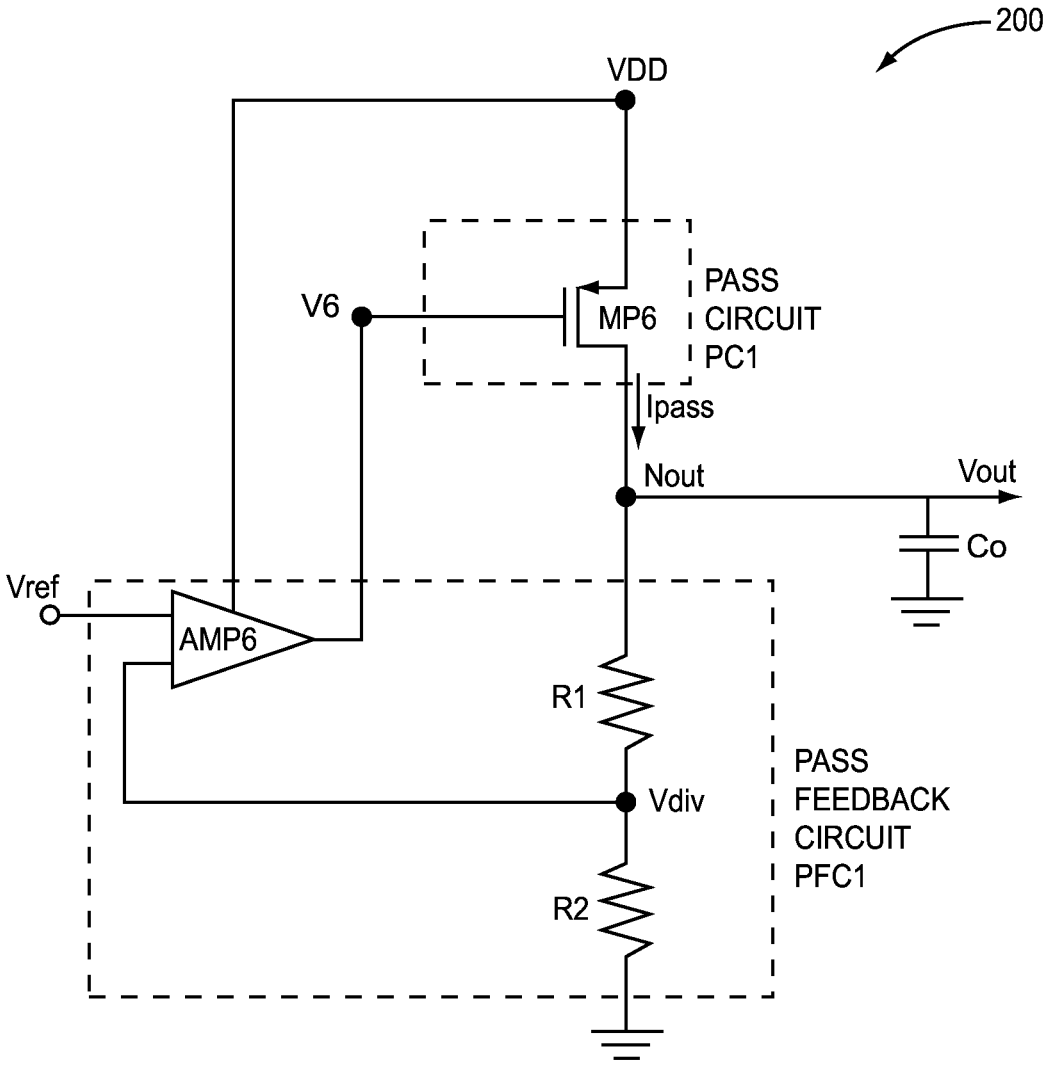
FIG. 2 illustrates a modified shunt voltage regulator from related art.
Figure 3:
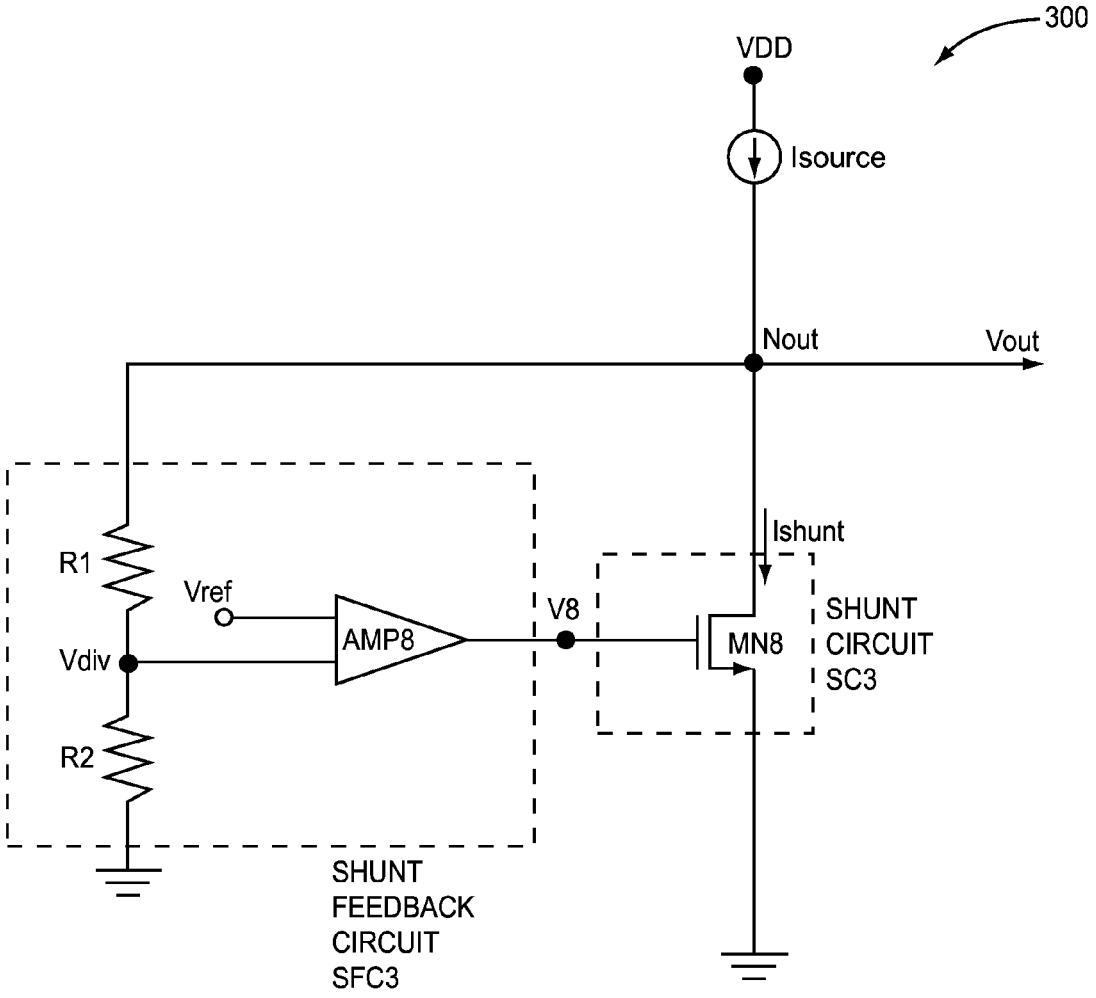
FIG. 3 illustrates a shunt voltage regulator from related art.
Figure 4:
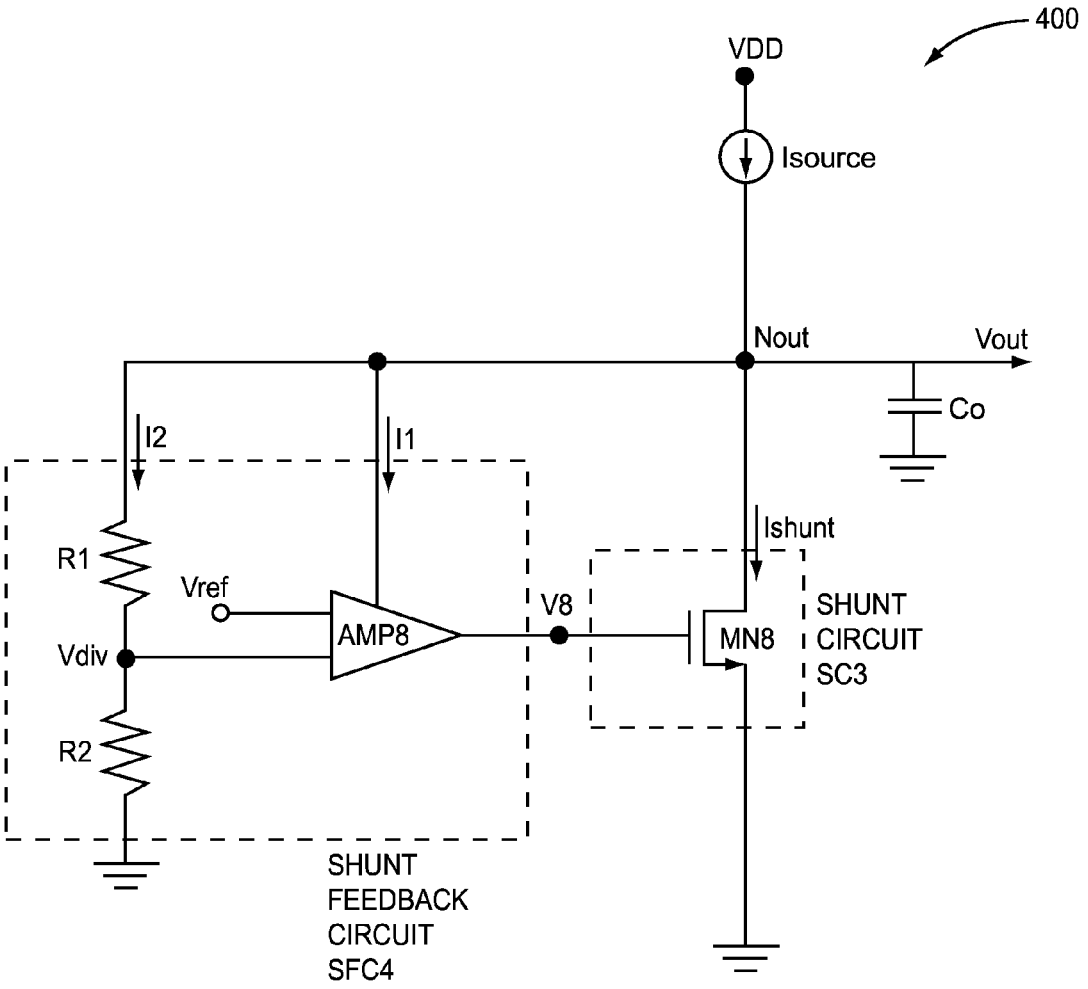
FIG. 4 illustrates a shunt voltage regulator with capacitor from related art.

However, in contrast to shunt voltage regulators 300 of related art, the hybrid voltage regulator 500 does not necessarily include any constant current source (such as Isource from FIGS. 3 and 4). Instead, the hybrid voltage regulator uses pass circuit PC5 as a variable current source that is a function of control voltage Vcont (also known as a bias voltage). The pass circuit PC5 receives a control voltage Vcont, and then sends a pass current Is1 that is a function of the control voltage Vcont. This pass current Is1 is variable, and in some ways substitutes for the fixed current source Isource of the related art (see shunt voltage regulators in FIGS. 3 and 4). Specifically, in hybrid voltage regulator 500 the pass circuit PC5 includes a PMOS transistor MP1 that receives a gate bias of Vcont from the Bias Controller BC5.

The bias controller BC5 receives shunt information (such as the error voltage V9 from the shunt feedback circuit, or a measurement of the shunt current I3) and outputs a control voltage Vcont as a function of the shunt information.

The embodiment in FIG. 5 illustrates the bias controller BC5 receiving error voltage V9 as shunt information. In one embodiment, the error voltage V9 is tied to the control voltage Vcont such that these voltages are equal (not shown).

Thus, the hybrid voltage regulator 500 is described as a "hybrid" because it has two simultaneous mechanisms for responding to a high output voltage Vout (or low load condition). First, the shunt feedback circuit sends a high error voltage V9 to the shunt circuit, increasing the shunt current I3.

Second, the bias controller BC5 receives shunt information (such as the error voltage V9 from the shunt feedback circuit SFC5, or a measurement of the shunt current I3) and sends a control voltage Vcont to the pass circuit PC5. With the pass circuit PC5 shown in FIG. 5 (including a PMOS transistor), a high Vcont decreases the pass current Is1. Both of these mechanisms simultaneously reduce Vout (but by entirely different mechanisms). Additionally, pass current Is1 is reduced in the low load condition, thus reducing power consumption relative to the related art shunt voltage regulators 300 (and their power hungry constant current source Isource).

Further, the shunt circuit SC5 in the hybrid voltage regulator 500 does not have to be able to be as large as the shunt circuit in the related art shunt voltage regulator 300, because the pass current Is1 is reduced in the low load condition (in contrast to the large constant Isource that is never reduced in the related art shunt voltage regulator 300).

The opposite results occur during a high load condition: a low error voltage V9 reduces shunt voltage I3, and Vcont is reduced to increase the pass current Is1. These two mechanisms simultaneously increase Vout.

Figure 6:
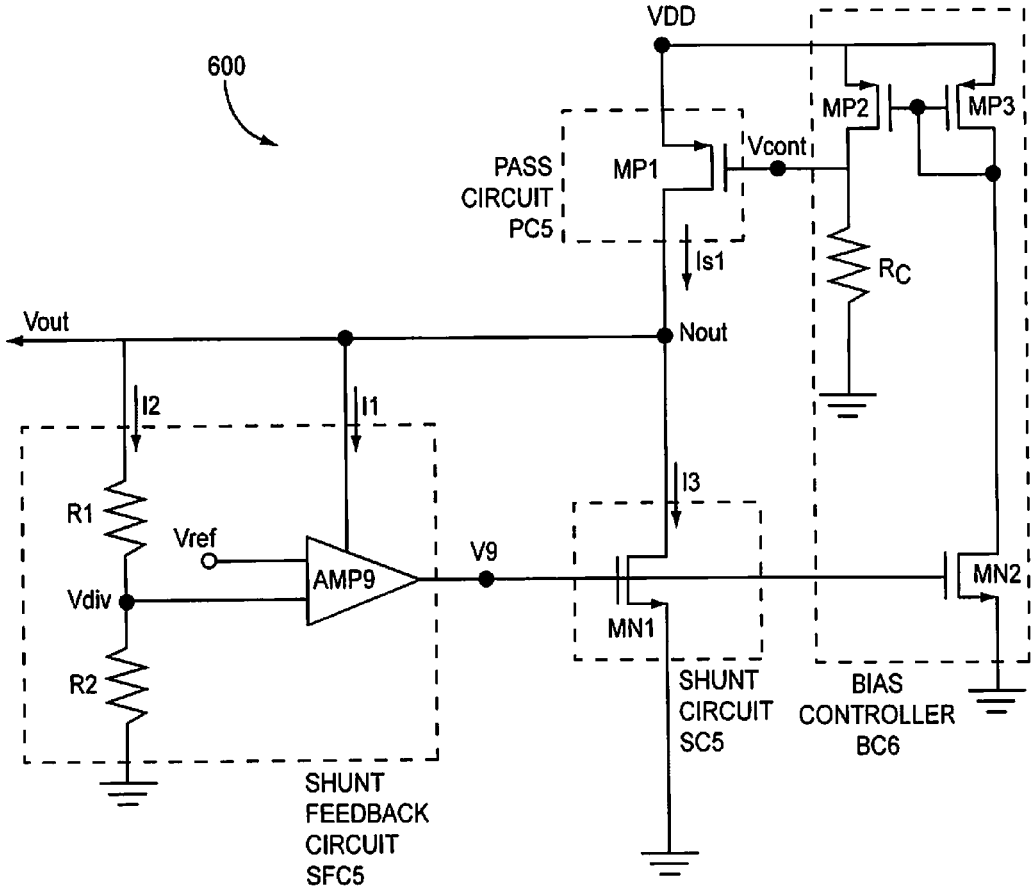
FIG. 6 illustrates a hybrid voltage regulator with mirror.

FIG. 6 illustrates a hybrid voltage regulator 600 with a current mirror (comprising transistors MP2 and MP3) as part of the bias controller BC6. A diode circuit (not shown) may be used in place of the current mirror. FIG. 6 is similar to FIG. 5, but also provides a detailed technical embodiment of a bias controller BC6.

The bias controller BC6 receives error voltage V9, and uses transistor MN2 and a pair of mirror transistors MP2 and MP3 to send control voltage Vcont to the pass circuit.

The pass circuit PC5 acts as a variable current source for variable pass current Is, effectively replacing the constant current source Isource of the related art shunt voltage regulator. Specifically (as discussed above in FIG. 5), the pass circuit PC5 includes a PMOS transistor MP1 that receives a gate bias voltage of Vcont from the bias controller BC6.

The bias controller BC6 generates Vcont as a function of shunt information (such as the error voltage V9 from the shunt feedback circuit SFC5, or a measurement of the shunt current I3). FIG. 6 illustrates using the error voltage V9 as shunt information.

Figure 7:
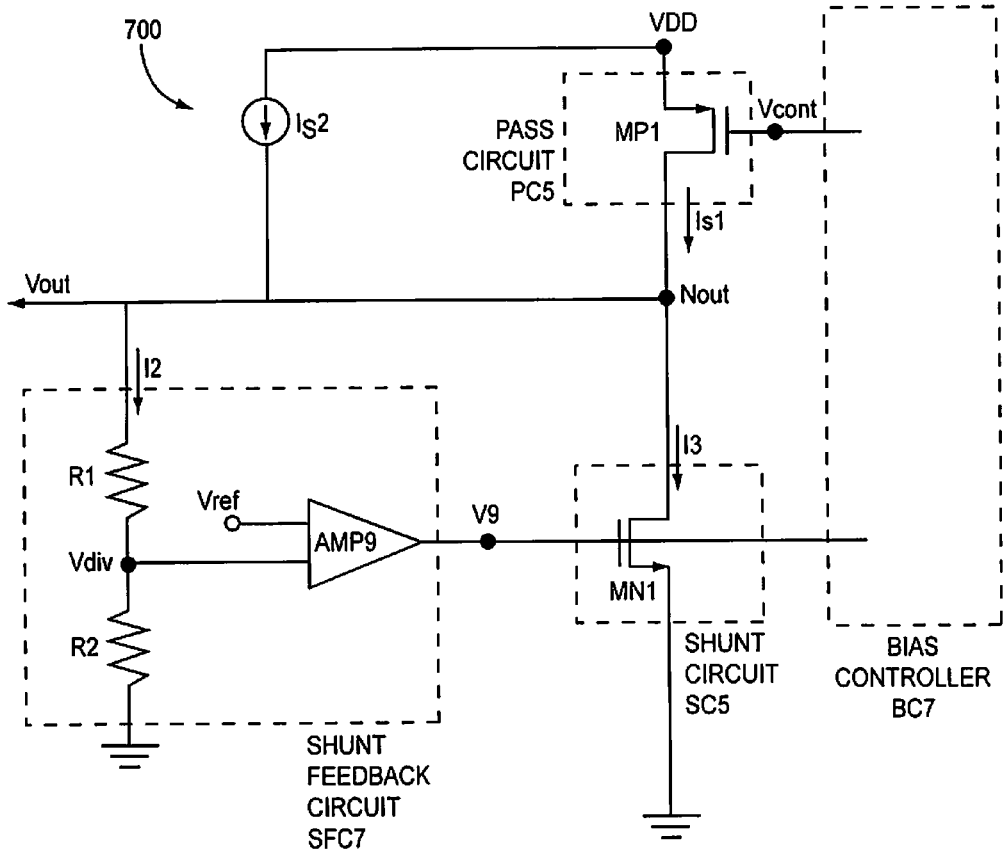
FIG. 7 illustrates a hybrid voltage regulator with current source.

FIG. 7 illustrates a hybrid voltage regulator 700 with a relatively small constant current source Is2. Constant current source Is2 improves transient response in the hybrid voltage regulator. Constant current source Is2 may be much smaller than a constant current source Isource in the related art shunt feedback circuit sized for similar loads. Additional discussion of Is2 is provided below regarding FIG. 8.

Figure 8:
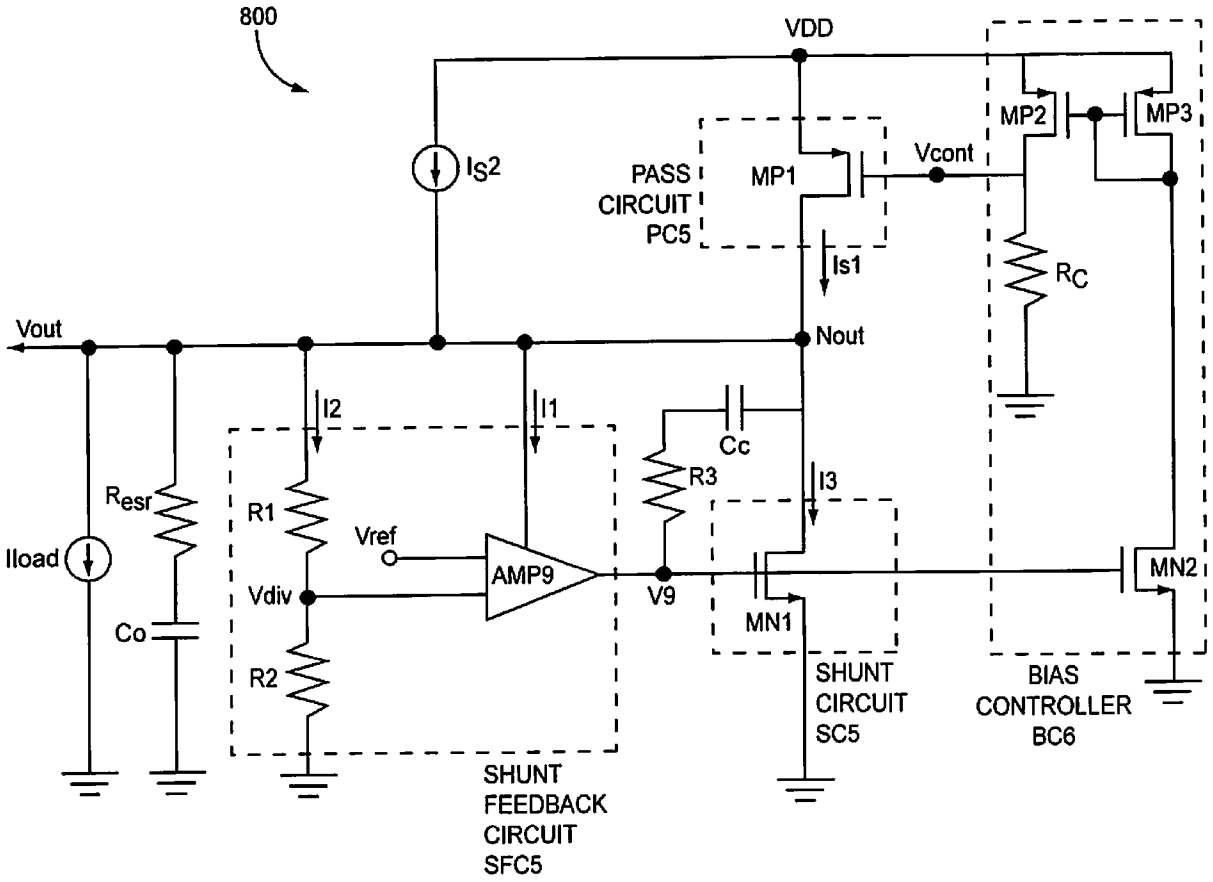
FIG. 8 illustrates a hybrid voltage regulator with mirror and with current source.

FIG. 8 illustrates a hybrid voltage regulator 800 with mirror transistors MP2 and MP3 in bias controller BC6, and with a constant current source Is2. FIG. 8 is similar to FIG. 6, with the addition of a constant current source Is2 as discussed in FIG. 7, and with additional technical detail.

The additional technical detail includes: a load current Iload that may vary from low current (under low load conditions, tending to initially increase Vout) to high current (under high load conditions, tending to initially lower Vout); and an additional resistor R3 in series with capacitor Cc to dampen oscillations in error voltage V9.

At a no load condition (Iload=0), error voltage V9 should increase (to increase the shunt current I3), and control voltage Vcont should increase (to decrease the pass current Is1). These two mechanisms should simultaneously decrease Vout.

In a no load condition, having a small constant current source Is2 improves transient response (when transitioning to a high load condition). In the no load condition, few or no micro-amperes flow through MP1 (thus minimizing power consumption). Thus, Is1 is very small, yielding the following equations:

$$I_{s2} >> I_{s1} \text{ and } I_{s2} \approx I_1 + I_2 + I_3 \qquad \text{(1)No load,yes } Is2.$$

Thus, Is2 should be sized to at least provide current to keep the shunt feedback circuit and the shunt circuit operating in a stable condition (I1 and I2 and I3). However, Is2 should be sized much smaller than Isource for a comparable related art shunt voltage regulator 300.

In a heavy load condition, Vcont should decrease (to increase the pass current Is1), and V9 should decrease (to decrease the shunt current I3). These two mechanisms should simultaneously increase Vout.

$$I_{s1} \approx I_{load}, \text{and } I_{s2} \approx I_1 + I_2 + I_3 \qquad \text{(2)Large load,yes } Is2.$$

If there is no constant current source Is2 (see FIG. 6), then the above equations are modified to become:

$$I_{s1} \approx I_1 + I_2 + I_3 = I_{s1@no_load} \qquad \text{(3)No load,no } Is2.$$

$$I_{s1} \approx I_{load} + I_{s1@no_load} \qquad \text{(4)Large load,no } Is2.$$

Multiple feedbacks (such as a shunt feedback circuit SFC5 and a bias controller BC5) can cause stability problems in circuits. The stability can be improved by adding a nested Miller compensation circuit between the output of amplifier and the output of voltage regulator (not shown).

Depending on the architecture of the error amplifier AMP9, the LDO output has a minimum voltage limitation of Vout. The output of the hybrid voltage regulator 800 should be at least equal to the minimum required voltage to operate the error amplifier AMP9.

Transistor MN1 and transistor MN2 do not need to be large (because pass current Is1 is variable). Pass circuit transistor MP1 does have to be large enough to pass the maximum load current, in order to supply the maximum load current for Iload.

The error amplifier AMP9 can be implemented with any type of amplifier. Depending on the error amplifier AMP9, a difference compensation scheme may be required. Is2 can be implemented using a diode device or a current mirror device (not shown).

One embodiment resolves the pass circuit implementation issue on CMOS shunt regulators by using a current sensing (or an error voltage sensing) bias controller to control the pass circuit.

Figure 9:
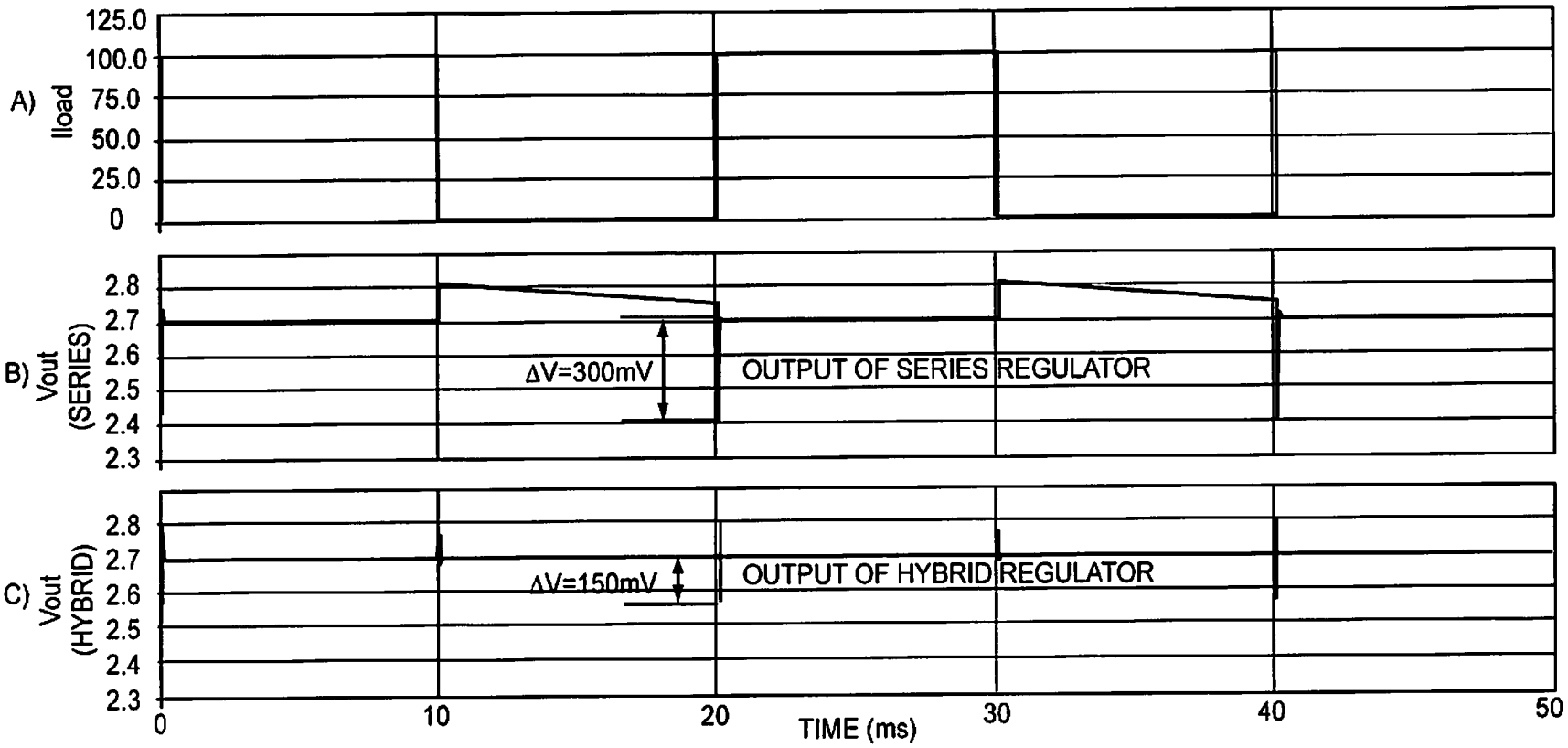
FIG. 9 illustrates load transient responses of series and hybrid regulators.

FIG. 9 illustrates load transient responses of a related art series voltage regulator 200 and a hybrid voltage regulator 500.

To verify the performance of a hybrid voltage regulator 800, its transient response and its PSR (power supply rejection) characteristics are simulated and are compared with a related art series voltage regulator 100. The hybrid voltage regulator 800 and the series voltage regulator 100 use identical error amplifiers (AMPG is identical to AMP9). Both regulators use identical pass devices (PC1 is identical to PC5), identical output capacitors (Co=1 μF), and identical output resistors (Resr=0.5 ohms).

In FIG. 9, the transient response of the series voltage regulator 100 is 14.34 μsec, and more than 10 msec at the rising and falling current steps (rising to full load, or falling to no load).

The transient response of the hybrid regulator 800 is 3.98 μsec, and about 99.4 μsec at the rising and falling steps (rising to full load, or falling to no load).

From the simulation results, the hybrid voltage regulator 800 has a settling time at least 4.5 times faster than that of the series voltage regulator 100. Transient voltage variation (ΔV) for the hybrid voltage regulator 800 is about 150 mV, and is much smaller than the 300 mV of the series voltage regulator 100.

Figure 10:
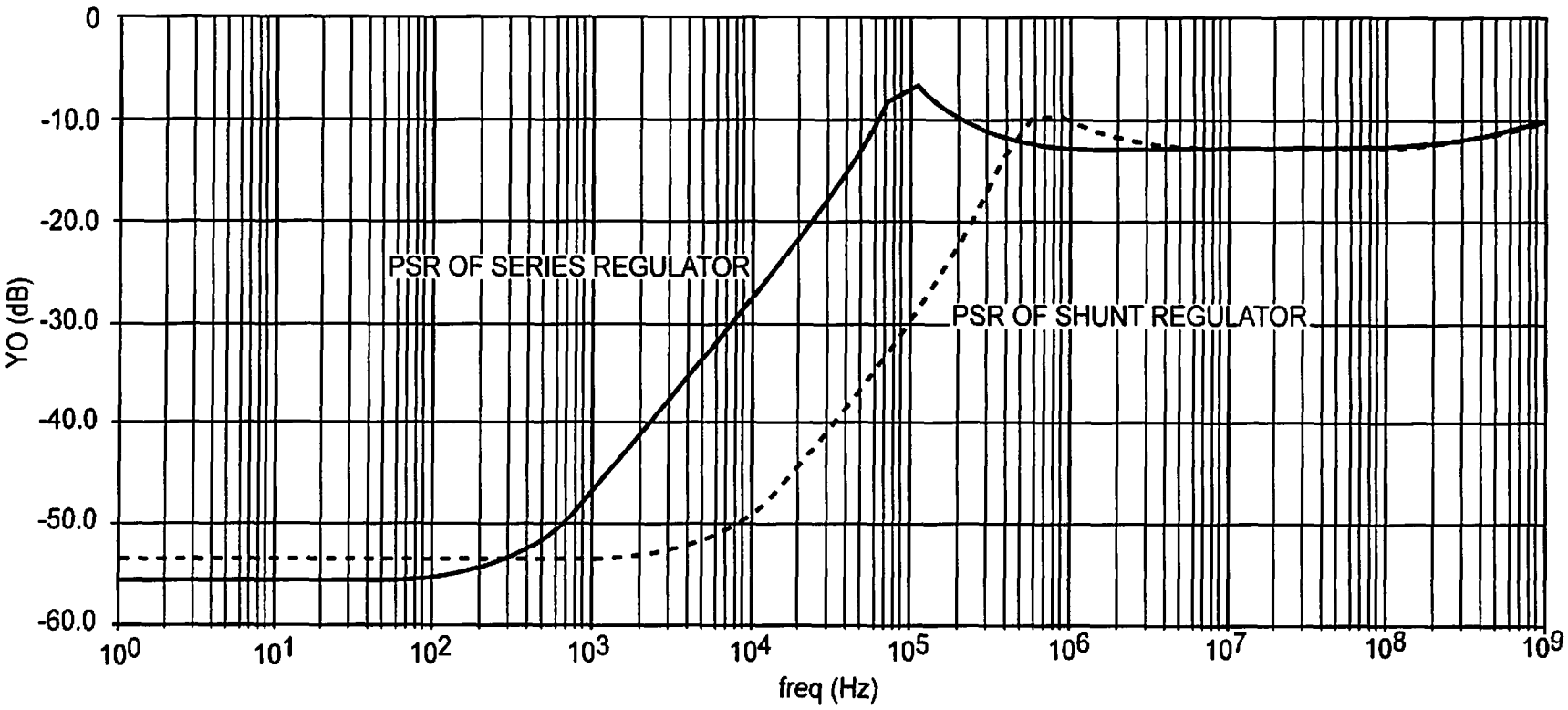
FIG. 10 illustrates Power Supply Rejection (PSR) responses of series and hybrid regulators.

FIG. 10 illustrates Power Supply Rejection (PSR) responses of series voltage regulator 100 and hybrid voltage regulator 800 at full load current currents Iload. The PSR response of series voltage regulator 100 shows −40 dB @ 2.4 kHz and −20 dB @ 23.4 kHz. The hybrid voltage regulator 100 shows a much wider PSR response such as −40 dB @ 34.4 kHz and −20 dB @ 238.7 kHz.

Table 1 shows the performance of the hybrid voltage regulator 800 compared with the series regulator.

TABLE 1

Performance comparison table.

| | Series regulator | hybrid regulator |
|---|---|---|
| Vin [V] | 3~5 | |
| Vout [V] | 2.7 | |
| Quiescent current Iq [μA] | 100.5 | 100.9 |
| Current Efficiency [%] | 99.91 | 99.87 |
| PSR | −27.1 dB @ 10 kHz<br>−7.2 dB @ 100 kHz | −48.5 dB @ 10 kHz<br>−30.0 dB @ 100 kHz |
| Transient time [μs] | 14.34 | 3.98 |
| Transient Output voltage variation (ΔV) | 300 mV | 150 mV |
| Load regulation | 0.087 mV/mA | 0.015 mV/mA |

As described above, the hybrid voltage regulator 800 provides better performance (current efficiency, PSR, transient time, transient output load variation, and load regulation) than a series voltage regulator. The hybrid features of the hybrid voltage generator 800 are also applicable to PA power controllers and switches.

For SOI Switches, the hybrid voltage regulator 800 may be used in a CMOS controller as a 2.5V regulator which supplies the −2.5V charge pump. Since the regulator has fast transient response when sinking and sourcing current, the ripple on the regulator when the charge pump is switching is minimized. This will reduce the spurious transmissions caused by the charge pump in the RX and TX bands.

For PA Controllers, the hybrid voltage regulator 800 may be used a reference voltage generator in applications where there is a switching converter. Since this hybrid voltage regulator has wide bandwidth PSR, the switching noise from the switching converter may be minimized.

Those skilled in the art will recognize improvements and modifications to the present disclosure. All such improvements and modifications are considered within the scope of the concepts disclosed herein.

What is claimed is:

1. A hybrid voltage regulator comprising:

an output node configured to provide an output signal having an output voltage;

a shunt feedback circuit comprising an error amplifier configured to receive the output signal and generate an error voltage based on the output voltage, wherein the output signal supplies power to the error amplifier;

a shunt circuit configured to receive the error voltage and to shunt a shunt current from the output node towards a ground;

a bias controller configured to receive shunt information and to generate a control voltage; and a pass circuit configured to receive an unregulated voltage, to receive the control voltage, and to send a pass current towards the output node;

wherein the shunt information relates to the shunt current.

2. The hybrid voltage regulator of claim 1, wherein the shunt information further relates to the error voltage.

3. The hybrid voltage regulator of claim 1, further comprising:

a constant current source configured to send a constant current towards the shunt feedback circuit to improve transient response of the hybrid voltage regulator.

4. The hybrid voltage regulator of claim 1, wherein the shunt feedback circuit is further configured to generate a divided voltage as a function of the output voltage, and configured to generate the error voltage as a function of a difference between the divided voltage and a reference voltage.

5. The hybrid voltage regulator of claim 1, wherein the shunt circuit is configured to receive the error voltage and to shunt the shunt current from the output node towards the ground as a function of the error voltage.

6. The hybrid voltage regulator of claim 1, wherein the pass circuit is configured to send the pass current towards the output node as a function of the control voltage.

7. The hybrid voltage regulator of claim 3, wherein the constant current source is sized substantially smaller than a constant current source in a comparably rated conventional shunt voltage regulator, and in a no load condition is sized large enough to keep the shunt feedback circuit in a stable state.

8. The hybrid voltage regulator of claim 7, wherein the constant current source is sized large enough to additionally keep the shunt circuit in a stable state in a no load condition.

9. The hybrid voltage regulator of claim 1, wherein the bias controller is configured to set the control voltage substantially equal to the error voltage.

10. A hybrid voltage regulator comprising:

an output node configured to provide an output signal having an output voltage;

a shunt feedback circuit comprising an error amplifier, configured to receive the output signal, configured to generate a divided voltage as a function of the output voltage, and configured to generate an error voltage as a function of a difference between the divided voltage and a reference voltage, wherein the output signal supplies power to the error amplifier;

a shunt circuit configured to receive the error voltage and to shunt a shunt current from the output node towards a ground as a function of the error voltage;

a bias controller configured to receive shunt information and to generate a control voltage; and a pass circuit configured to receive an unregulated voltage, to receive the control voltage, and to send a pass current towards the output node as a function of the control voltage;

wherein the shunt information relates to the shunt current.

11. The hybrid voltage regulator of claim 10, further comprising:

a constant current source configured to send a constant current towards the shunt feedback circuit to improve transient response of the hybrid voltage regulator.

12. The hybrid voltage regulator of claim 11, wherein the constant current source is sized substantially smaller than a constant current source in a comparably rated conventional shunt voltage regulator, and in a no load condition is sized large enough to keep the shunt feedback circuit in a stable state.

13. The hybrid voltage regulator of claim 12, wherein the constant current source is sized large enough to additionally keep the shunt circuit in a stable state in a no load condition.

14. The hybrid voltage regulator of claim 10, wherein the bias controller is configured to set the control voltage substantially equal to the error voltage.

15. The hybrid voltage regulator of claim 10, wherein the shunt information further relates to the error voltage.

* * * * *